US009519263B2

(12) United States Patent
Tomine

(10) Patent No.: US 9,519,263 B2
(45) Date of Patent: Dec. 13, 2016

(54) IMAGE FORMING APPARATUS INCLUDING PROCESSES EXECUTED AFTER IMAGE FORMATION AND BEFORE CARTRIDGE REMOVAL

(71) Applicant: CANON KABUSHIKI KAISHA, Tokyo (JP)

(72) Inventor: Jun Tomine, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/957,136

(22) Filed: Dec. 2, 2015

(65) Prior Publication Data

US 2016/0161901 A1 Jun. 9, 2016

(30) Foreign Application Priority Data

Dec. 5, 2014 (JP) ..... 2014-246696

(51) Int. Cl.
*G03G 21/16* (2006.01)
*G03G 15/00* (2006.01)
*G03G 21/18* (2006.01)

(52) U.S. Cl.
CPC ..... *G03G 21/169* (2013.01); *G03G 15/55* (2013.01); *G03G 21/1889* (2013.01)

(58) Field of Classification Search
USPC ..... 399/9, 24–26, 71, 107, 109–111, 343
See application file for complete search history.

(56) References Cited

U.S. PATENT DOCUMENTS

2010/0067935 A1* 3/2010 Nakamura ..... G03G 15/553 399/71
2011/0217075 A1* 9/2011 Uehara ..... G03G 21/1853 399/114
2013/0164028 A1* 6/2013 Morioka ..... G03G 21/1821 399/111
2014/0153946 A1* 6/2014 Kobayashi ..... G03G 15/1605 399/66

FOREIGN PATENT DOCUMENTS

JP 11-24521 A 1/1999
JP 3910261 B2 4/2007

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a cartridge detachably attachable to the image forming apparatus, the cartridge including an image bearing member and a cleaning member which abuts against the image bearing member to remove remaining developer on the image bearing member; an inputting portion into which information for detaching the cartridge from the image forming apparatus is inputted; and an execution portion capable of executing, after an operation of forming an image on a recording material is finished, a first operation of rotating the image bearing member in a direction reverse to a rotation direction of the image bearing member and a second operation of rotating the image bearing member in the rotation direction of the image bearing member when the information is inputted to the inputting portion.

4 Claims, 8 Drawing Sheets

IMAGE FORMING APPARATUS INCLUDING PROCESSES EXECUTED AFTER IMAGE FORMATION AND BEFORE CARTRIDGE REMOVAL

BACKGROUND OF THE INVENTION

Field of the Invention

The present invention relates to an image forming apparatus which uses an electrophotographic system such as a laser beam printer, a copying machine, and a facsimile machine.

Description of the Related Art

Japanese Patent Laid-Open No. 11-24521 discloses a technique in which a control device rotates a photosensitive drum (image bearing member) in a reverse direction after a necessary number of copies are made (after the finish of job) in accordance with the amount of toner on the surface of the photosensitive drum (image bearing member). Such a configuration prevents a phenomenon in which a lubricating oil on the surface of the photosensitive drum is scraped off or a cleaning blade is rolled up.

However, in the configuration of Japanese Patent Laid-Open No. 11-24521, when the photosensitive drum is incorporated in a cartridge, toner located on the cleaning blade on the photosensitive drum may be exposed to the outside of the cartridge. In this case, a user may make his/her hand dirty by the exposed toner on the photosensitive drum when replacing the cartridge.

SUMMARY OF THE INVENTION

In view of the above circumstances, it is desirable to provide an image forming apparatus capable of preventing a user from making his/her hand dirty by touching an image bearing member when a cartridge is taken out from an apparatus body in a configuration that rotates the image bearing member in a reverse direction after the finish of job.

An image forming apparatus comprising: a cartridge detachably attachable to the image forming apparatus, the cartridge including an image bearing member and a cleaning member which abuts against the image bearing member to remove a remained developer on the image bearing member after a toner image formed on the image bearing member is transferred to a transferred material; an inputting portion into which information for taking out the cartridge from the image forming apparatus is inputted; and an execution portion capable of executing a first operation of rotating the image bearing member in a direction reverse to a rotation direction of the image bearing member after an operation of forming an image is finished and a second operation of rotating the image bearing member in the rotation direction of the image bearing member when the information is inputted to the inputting portion.

Further features of the present invention will become apparent from the following description of exemplary embodiments with reference to the attached drawings.

DESCRIPTION OF THE EMBODIMENT

Figure 1:
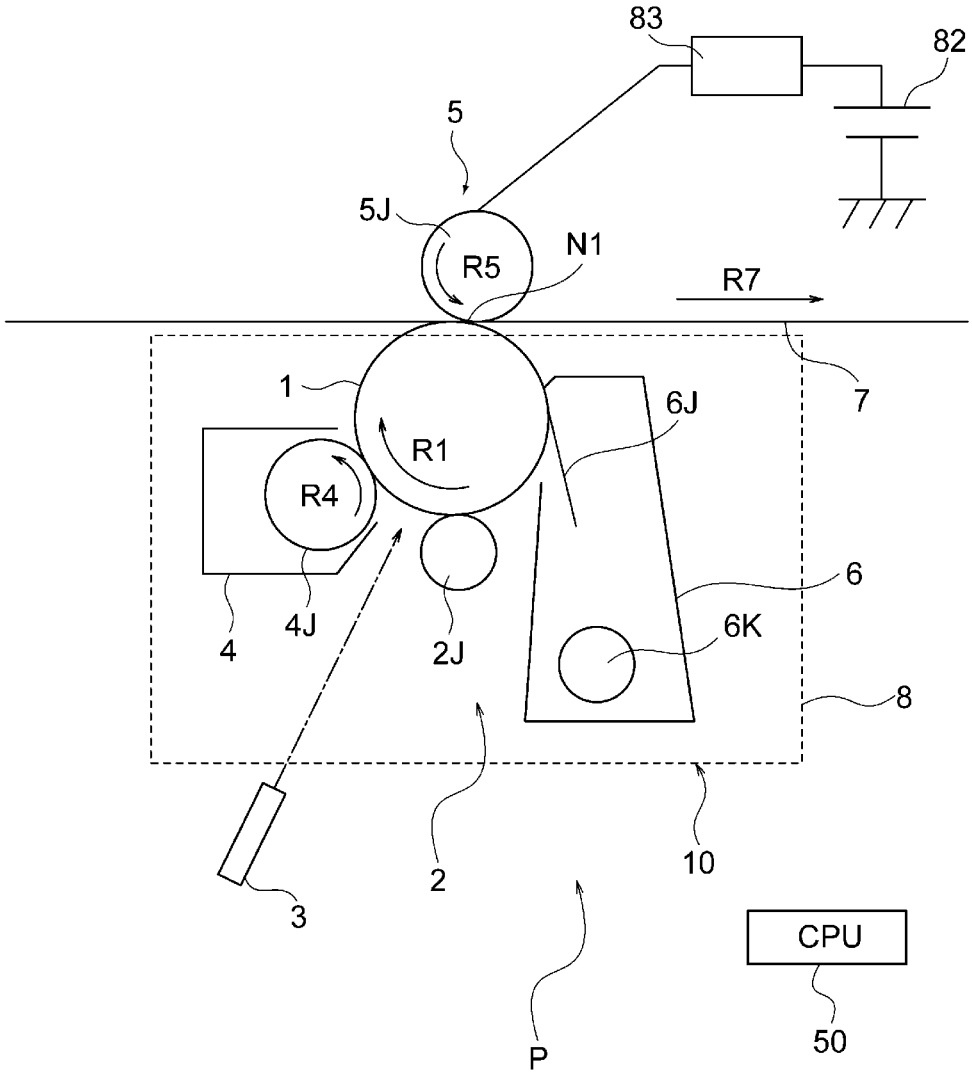
FIG. 1 is a sectional view of one image forming portion disposed inside an image forming apparatus according to a first embodiment.

Hereinbelow, an embodiment for carrying out the invention will be illustratively and specifically described based on an exemplary embodiment with reference to the drawings. It is to be noted that the size, material, shape, and relative position of components described in the exemplary embodiment are appropriately changed in accordance with the configuration of an apparatus to which the invention is applied or various conditions. Thus, the scope of the invention is not intended to be limited only thereto unless otherwise specifically stated.

[First Embodiment]

Hereinbelow, an embodiment of the present invention will be described with reference to the drawings. Identical reference numerals designate elements having similar configurations or similar actions throughout the drawings, and overlapping description for these elements is appropriately omitted.

(Configuration of Image Forming Apparatus)

FIG. 1 is a sectional view of one image forming portion P disposed inside an image forming apparatus 100 according to a first embodiment. The image forming apparatus 100 includes an apparatus body 100A (refer to FIG. 2). The image forming portion P is disposed inside the apparatus body 100A. The image forming portion P includes, as an image bearing member, a drum-shaped photosensitive drum 1 of an electrophotographic system. The photosensitive drum 1 is rotated by a drive portion (not illustrated) in a direction indicated by an arrow R1 at a process speed (circumferential velocity) of 100 mm/sec. A charging device 2 (charging portion), an exposure device 3 (exposure portion), a development device 4 (development portion), a primary transfer device 5, and a cleaning device 6 are disposed around the photosensitive drum 1 substantially in this order along the rotation direction of the photosensitive drum 1.

A charging roller 2J as a part of the "charging portion" uniformly charges the surface of the photosensitive drum 1. The exposure device 3 as the "exposure portion" exposes the surface of the photosensitive drum 1 charged by the charging roller 2J to light to form an electrostatic image on the surface of the photosensitive drum 1. A development roller 4J (which rotates in a direction indicated by an arrow R4) as a part of the "development portion" develops the electrostatic image on the surface of the photosensitive drum 1 with a developer to from a developer image on the surface of the photosensitive drum 1. A cleaning blade 6J as a part of the "cleaning portion" abuts against the surface of the photosensitive drum 1 to remove a remained developer remaining on the surface of the photosensitive drum 1.

The photosensitive drum 1, the charging device 2 which includes the charging roller 2J, the development device 4 which includes the development roller 4J, and the cleaning device 6 which includes the cleaning blade 6J are integrated to constitute a cartridge 10. The cartridge 10 is detachably attachable to the apparatus body 100A. The apparatus body 100A includes the exposure device 3 and the primary transfer device 5. A primary transfer roller 5J as a part of the "primary transfer portion" transfers the developer image on the surface of the photosensitive drum 1 to an intermediate transfer belt 7 as an "intermediate transfer member" or a recording material.

A CPU 50 (controller) as an "execution portion" controls drive of the photosensitive drum 1, the charging roller 2J, and the development roller 4J. As will be described below, the CPU 50 performs the following operation before the cartridge 10 is taken out of the apparatus body 100A. The CPU 50 is connected to a display portion 506 (input portion, output portion) (operation portion). The display portion 506 functions as the input portion into which a user can input information for taking out the cartridge 10 from the apparatus body 100A (information about replacement of the cartridge 10 or information for replacing the cartridge 10) (refer to S3 of FIG. 7) and also functions as the output portion which outputs a signal for outputting information that urges replacement of the cartridge 10 (refer to S2 of FIG. 7).

Specifically, when the life of the photosensitive drum 1 has been detected, the CPU 50 can execute, on the basis of information for replacing the cartridge 10 (replacement signal) input to the display portion 506 by a user, a second operation (mode) of rotating the photosensitive drum 1 in a rotation direction during image formation (the same direction as the rotation direction during image formation) for a second predetermined time after the reception of the replacement signal. In this case, when information about replacement of the cartridge 10 (information urging replacement) is output from the display portion 506, the CPU 50 also can perform control for stopping (preventing the execution of) a first operation (mode) of rotating the photosensitive drum 1 in a direction reverse to the rotation direction during image formation.

The second operation (mode) of rotating the photosensitive drum 1 in the rotation direction during image formation upon detecting the life of the photosensitive drum 1 is performed after the CPU 50 stops the rotation of the photosensitive drum 1 and separates the photosensitive drum 1 from the primary transfer roller 5J. This operation allows aggregated and stuck toner T as an "accumulated developer" which is accumulated on the surface of the photosensitive drum 1 (refer to FIG. 3) to be collected into the cartridge 10.

When the life of the photosensitive drum 1 has not been detected, the CPU 50 can execute the following first operation for a first predetermined time after finishing image formation by stopping the rotation of the photosensitive drum 1. Specifically, the CPU can execute a mode of stopping the photosensitive drum 1 after rotating the photosensitive drum 1 in the direction reverse to the rotation direction during image formation. This operation separates the aggregated and stuck toner T located in front of the cleaning blade 6J from the cleaning blade 6J. Further, the CPU 50 enables a user to execute replacement of the photosensitive drum 1.

The surface of the photosensitive drum 1 as the "image bearing member" is charged by the charging roller 2J. An electrostatic image is formed on the charged surface of the photosensitive drum 1 by the exposure device 3. The electrostatic image on the surface of the photosensitive drum 1 is developed by the development device 4. The toner used in the present embodiment has a negative charge polarity.

A toner image formed on the surface of the photosensitive drum 1 is transferred to the surface of the intermediate transfer belt 7 as the intermediate transfer member which is a different member by the primary transfer device 5. The primary transfer device 5 includes a primary transfer roller 5J (contact charging member) which abuts against the photosensitive drum 1, a transfer bias applying power source 82 which applies a transfer bias to the primary transfer roller 5J, and a control device (controller) 83 which controls the transfer bias applying power source 82.

The toner image formed on the surface of the photosensitive drum 1 is electrostatically primary-transferred to the surface of the intermediate transfer belt 7 in a primary transfer nip portion N1 by the application of a primary transfer bias to the primary transfer roller 5J from the transfer bias applying power source 82. The primary transfer bias in the present embodiment includes a direct-current (DC) voltage (DC component) and has an opposite-polarity to charge characteristics (regular charge polarity) of the toner.

Toner (residual toner) remaining on the surface of the photosensitive drum 1 without being transferred to the intermediate transfer belt 7 during the primary transfer is removed by the cleaning blade 6J of the cleaning device 6 and collected into a waste toner container (not illustrated) by a waste toner conveying screw 6K.

In the present embodiment, the photosensitive drum 1, the charging device 2, the development device 4, and the cleaning device 6 are integrally incorporated in a cartridge container 8 (indicated by a dotted line in FIG. 1) to constitute the cartridge (process cartridge) 10 as a whole.

Figure 2:
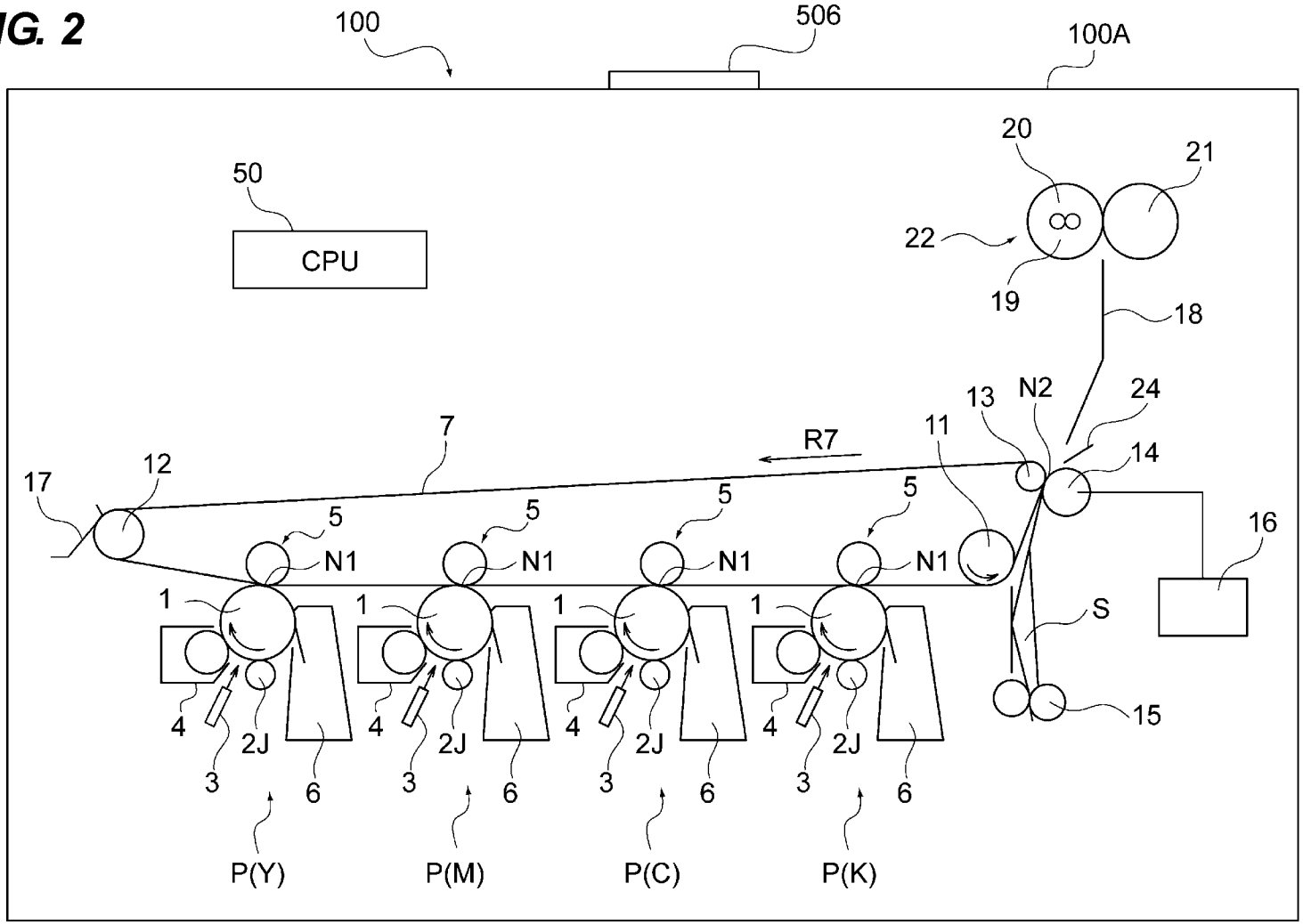
FIG. 2 is a sectional view of the image forming apparatus.

FIG. 2 is a sectional view of the image forming apparatus 100. The image forming apparatus 100 includes the apparatus body 100A. Four image forming portions P(Y), P(M), P(C), and P(K) each of which is substantially similar to the image forming portion P are disposed inside the apparatus body 100A. The image forming portions P(Y), P(M), P(C), and P(K) respectively form toner images of yellow (Y), magenta (M), cyan (C), and black (K).

Each of the image forming portions P(Y), P(M), P(C), and P(K) has the following components inside thereof similarly to the image forming portion P of FIG. 1. That is, the photosensitive drum 1, the charging device 2, the exposure device 3, the development device 4, the primary transfer device 5, and the cleaning device 6 are disposed in each of the image forming portions P(Y), P(M), P(C), and P(K).

Yellow, magenta, cyan, and black toner images are respectively formed on the photosensitive drums 1 of the image forming portions P(Y), P(M), P(C), and P(K) similarly to the image forming portion P described above. In FIG. 2, members corresponding to the transfer bias applying power source 82 and the control device 83 in FIG. 1 are not illustrated.

These toner images of four colors are sequentially primary-transferred onto the intermediate transfer belt 7 as the intermediate transfer member. The intermediate transfer belt 7 is formed of a dielectric resin such as polyimide in an endless form. A secondary transfer roller 14 abuts against the surface of the intermediate transfer belt 7 at a position corresponding to a secondary transfer counter roller 13. A secondary transfer nip portion N2 is formed between the secondary transfer roller 14 and the intermediate transfer belt 7.

The primary transfer bias is applied to the primary transfer roller 5J (rotating in a direction indicated by an arrow R5) of each primary transfer device 5. Accordingly, the yellow, magenta, cyan, and black toner images respectively formed on the photosensitive drums 1 (rotating in the direction indicated by the arrow R1) of the image forming portions P(Y), P(M), P(C), and P(K) are primary-transferred to the intermediate transfer belt 7 in the respective primary transfer nip portions N1 and overlapped with each other on the intermediate transfer belt 7.

The toner images of four colors overlapped on the intermediate transfer belt 7 in this manner are transferred to a recording material S by the secondary transfer roller 14. The intermediate transfer belt 7 is nipped between the secondary transfer roller 14 and the secondary transfer counter roller 13. Accordingly, the secondary transfer nip portion N2 is formed between the secondary transfer roller 14 and the intermediate transfer belt 7.

The recording material S to be subjected to image formation (conveyed in a direction indicated by an arrow R7) is stored in a sheet cassette (not illustrated) and conveyed to a registration roller 15 by a feeding/conveying device which includes a feeding roller, a conveying roller, and a conveying guide (all not illustrated). Skew feeding of the recording material S is corrected in the registration roller 15. Then, the recording material S is supplied to the secondary transfer nip portion N2. A secondary transfer bias is applied to the secondary transfer roller 14 from a secondary transfer high-voltage power source 16 when the recording material S passes through the secondary transfer nip portion N2.

The secondary transfer bias at this time has a positive polarity which is opposite to the charge characteristics of the toner (negative). The toner images of four colors on the intermediate transfer belt 7 are collectively secondary-transferred to the recording material S by the transfer bias. At this time, toner (residual toner) remaining on the intermediate transfer belt 7 without being transferred to the recording material S is removed by a belt cleaner 17 which is disposed at a position corresponding to a follower roller 12.

The recording material S with the secondary-transferred toner images is conveyed to a fixing device 22 along a conveying guide 18. The recording material S is heated and pressurized by a fixing roller 20 and a pressure roller 21 when passing through a fixing nip portion so that the toner images are fixed on the surface thereof. Accordingly, image formation with full four colors with respect to a single recording material S is finished.

Similarly to the cartridge 10 illustrated in FIG. 1, the photosensitive drum 1, the charging device 2, the development device 4, and the cleaning device 6 are integrally incorporated in a cartridge container (not illustrated) to constitute a cartridge for yellow which is detachably attachable to the apparatus body 100A. For the other colors, that is, magenta, cyan, and black, cartridges for magenta, cyan, and black are constituted in the same manner. The apparatus body 100A includes the display portion 506 for transmitting the fact that the cartridge 10 is replaceable to a user.

Figure 3A:
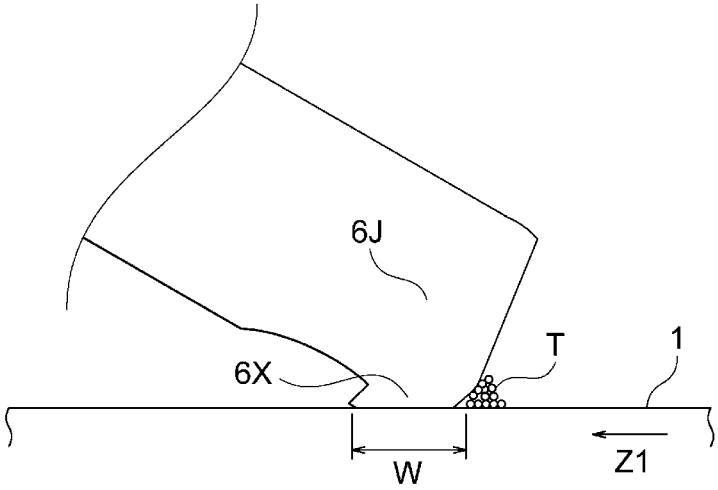
FIGS. 3A and 3B are sectional diagrams illustrating a state of a cleaning blade and a photosensitive drum when the photosensitive drum rotates in a normal rotation direction.
Figure 3B:
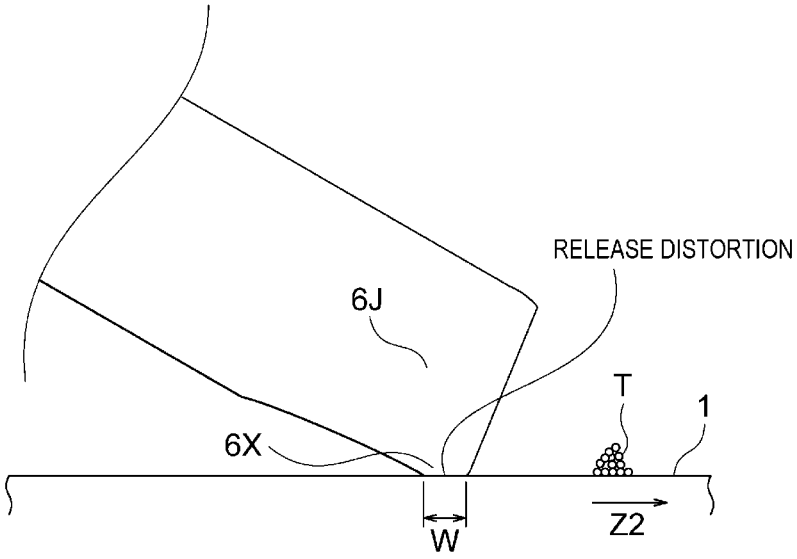

FIG. 3A is a sectional diagram illustrating a state of the cleaning blade 6J and the photosensitive drum 1 when the photosensitive drum 1 rotates in a normal rotation direction Z1. In particular, FIGS. 3A and 3B illustrate a state of an edge 6X of the cleaning blade 6J. Hereinbelow, the sequence of stopping the photosensitive drum 1 after image formation will be described with reference to FIGS. 3A and 3B. The cleaning blade 6J made of rubber abuts against the surface of the photosensitive drum 1 at an abutment portion W.

As illustrated in FIG. 3A, the photosensitive drum 1 rotates in the normal rotation direction Z1 during image formation. The edge 6X located at the distal end side of the cleaning blade 6J abuts against the photosensitive drum 1 in a counter direction of the photosensitive drum 1 which rotates in the normal rotation direction Z1 to apply a predetermined pressing force to the photosensitive drum 1. The edge 6X located at the distal end side of the cleaning blade 6J is brought into intimate contact with the photosensitive drum 1 by the abutment pressure against the photosensitive drum 1 and the occurrence of distortion caused by being dragged by the photosensitive drum 1 by abutment against the photosensitive drum 1 in the counter direction.

The edge 6X wipes the surface of the photosensitive drum 1 to scrape off the transfer residual toner T from the surface of the photosensitive drum 1. The toner scraped by the edge 6X is accumulated in front of the edge 6X. When the rotation of the photosensitive drum 1 is stopped with the toner T accumulated, the toner T is aggregated and stuck to the surface of the photosensitive drum 1 to from aggregated and stuck toner T. When the photosensitive drum 1 is actuated to rotate in the normal rotation direction Z1 next time, the aggregated and stuck toner T may pass through the edge 6X.

Due to the aggregated and stuck toner T that has passed through the edge 6X, a sliding property when the edge 6X of the cleaning blade 6J slides on the surface of the photosensitive drum 1 changes in a region of the abutment portion W on the surface of the photosensitive drum 1. That is, since parts of all photosensitive drums 1 having the same drive system in which the frictional coefficient μ is reduced appear at the same period, the drive load fluctuates when the aggregated and stuck toner T of the photosensitive drums 1 passes through the edges 6X of the cleaning blades 6J at the same timing.

Then, when electrostatic images are formed on the surfaces of the photosensitive drums 1 by the exposure devices 3 during the fluctuation, streaks of a drum pitch of the photosensitive drums 1 appears on the images. The influence of this principle remarkably occurs particularly in a half-tone image.

FIG. 3B is a sectional diagram illustrating a state of the cleaning blade 6J and the photosensitive drum 1 when the photosensitive drum 1 rotates in a reverse rotation direction Z2. In order to solve the above problem, the photosensitive drum 1 is rotated in the reverse rotation direction Z2 when the photosensitive drum 1 comes to a stop after the finish of image formation so that the aggregated and stuck toner T located in front of the edge 6X located at the distal end side of the cleaning blade 6J is separated from the edge 6X.

Further, at the same time, the following occurs in the cleaning blade 6J. Specifically, as illustrated in FIG. 3A, distortion occurs by the rotation of the photosensitive drum 1 in the normal rotation direction Z1. However, as illustrated in FIG. 3B, the rotation of the photosensitive drum 1 in the reverse rotation direction Z2 eliminates the distortion to reduce plastic deformation and thereby ensures a stable cleaning performance.

Figure 4:
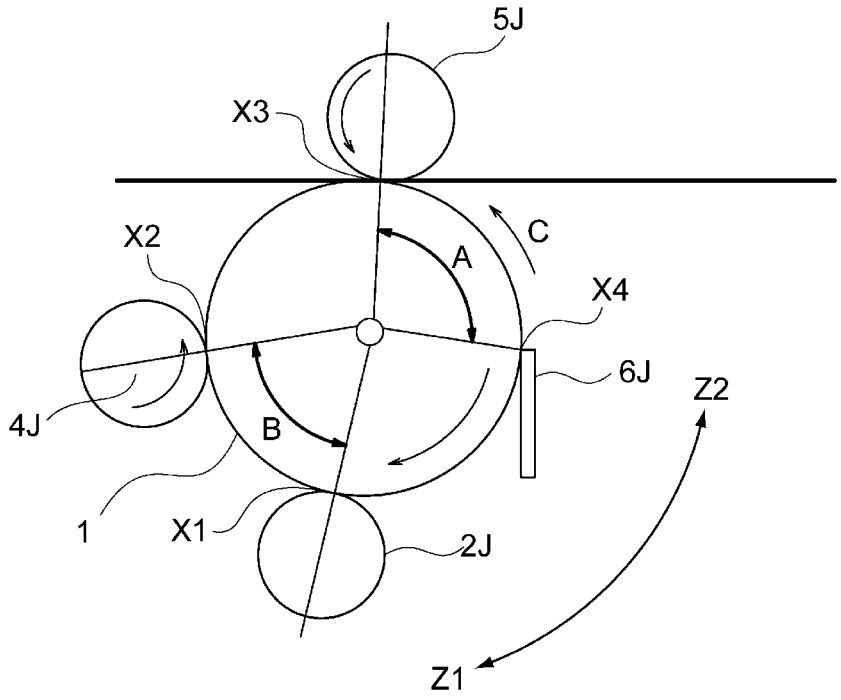
FIG. 4 is a schematic diagram illustrating the configuration of the photosensitive drum and its surroundings.

FIG. 4 is a schematic diagram illustrating the configuration of the photosensitive drum 1 and its surroundings. A charging facing position X1 on the surface of the photosensitive drum 1 faces the charging roller 2J. A development facing position X2 on the surface of the photosensitive drum 1 faces the development roller 4J. A transfer facing position X3 on the surface of the photosensitive drum 1 faces the primary transfer roller 5J. A cleaning facing position X4 on the surface of the photosensitive drum 1 faces the cleaning blade 6J.

The distance on the peripheral face between the charging facing position X1 and the development facing position X2 is defined as a second distance B (second peripheral face distance). The distance on the peripheral face between the transfer facing position X3 and the cleaning facing position X4 is defined as a first distance A (first peripheral face distance). When the second distance B< the first distance A is satisfied, a reverse direction rotation amount C by which the photosensitive drum 1 is rotated in the reverse rotation direction Z2 which is reverse to the rotation direction during image formation is set smaller than the second distance B due to the following reason.

Toner is transferred to the photosensitive drum 1 from the development roller 4J. Thus, when the photosensitive drum 1 rotates in the reverse rotation direction Z2 by an amount larger than the reverse direction rotation amount C, toner adhered to the surface of the photosensitive drum 1 at the development facing position X2 reaches the charging facing position X1 on the surface of the photosensitive drum 1. In this case, the aggregated and stuck toner T is stuck to the surface of the photosensitive drum 1 at the charging facing position X1. The above setting is made to avoid this problem.

On the other hand, when design is made to satisfy the first distance A< the second distance B, the reverse direction rotation amount C by which the photosensitive drum 1 is rotated in the reverse rotation direction Z2 which is reverse to the rotation direction during image formation is set smaller than the first distance A due to the following reason. When the photosensitive drum 1 rotates in the reverse rotation direction Z2 by an amount larger than the reverse direction rotation amount C, toner adhered to the surface of the photosensitive drum 1 at the cleaning facing position X4 which faces the cleaning blade 6J reaches the primary transfer roller 5J. In this case, the aggregated and stuck toner T is stuck to the surface of the photosensitive drum 1 at the transfer facing position X3. The above setting is made to avoid this problem.

In view of the above, it is desired that the photosensitive drum 1 does not rotate in the reverse rotation direction Z2 by the reverse direction rotation amount C larger than either smaller one, the second distance B or the first distance A. It is needless to say that the reverse direction rotation amount C of the photosensitive drum 1 is more desirably smaller than both the second distance B and the first distance A.

Figure 5:
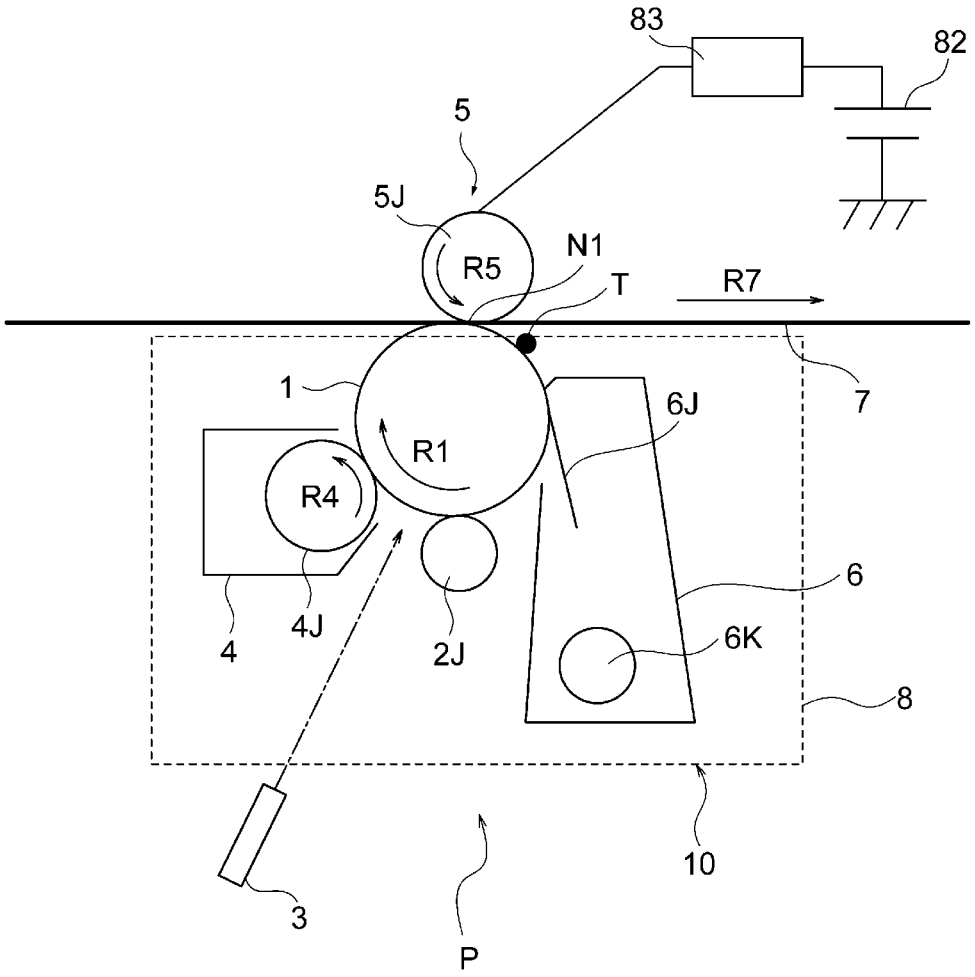
FIG. 5 is a sectional view of the inside of a cartridge illustrating a state when the photosensitive drum comes to a stop.

FIG. 5 is a sectional view of the inside of the cartridge 10 when the photosensitive drum 1 comes to a stop. The aggregated and stuck toner T remains on the surface of the photosensitive drum 1 in a part with no cover of the cartridge 10. In this case, a user or an operator may touch the aggregated and stuck toner T when replacing the cartridge 10.

Figure 6:
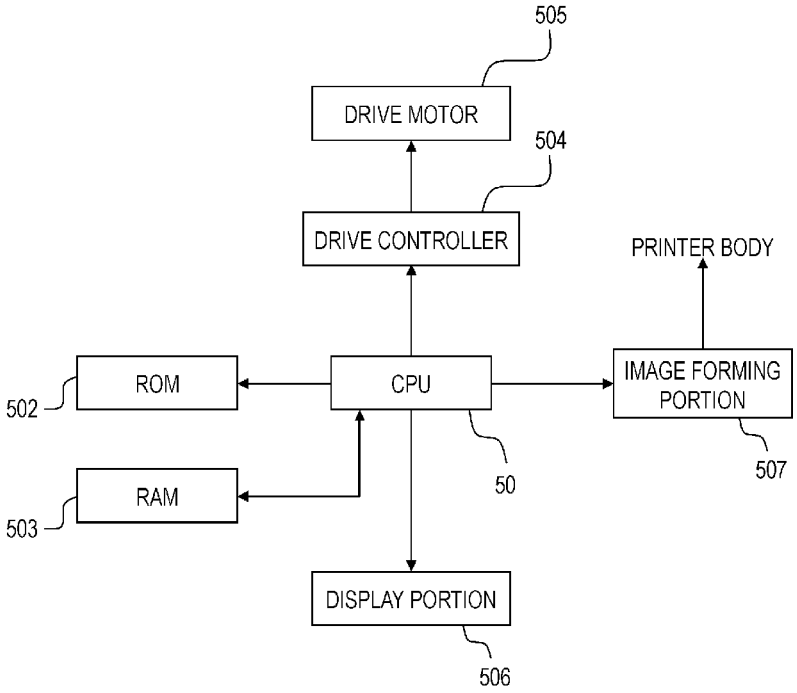
FIG. 6 is a block diagram of a control system and a mechanism connected to the control system.

FIG. 6 is a block diagram of a control system and a mechanism connected to the control system. The CPU 50 illustrated in FIG. 6 controls each portion of the image forming apparatus 100 on the basis of a control program stored in ROM 502 while using RAM 503 as a work area. The control program, various data, and a table are stored in the ROM 502. The RAM 503 includes a program load area, a work area of the CPU 50, and a storage area for various data. The RAM 503 stores the cumulative number of passing sheets in terms of A4.

As described above, the image forming portion 507 includes the charging device 2, the exposure device 3, the development device 4, and the primary transfer device 5. The charging device 2 uniformly charges the surface of the photosensitive drum 1. The exposure device 3 converts a toner output signal into light intensity on the basis of image data transmitted from the CPU 50 and exposes the surface of the photosensitive drum 1 to light. The development device 4 develops an electrostatic image formed on the surface of the photosensitive drum 1 with toner to from a toner image. The primary transfer device transfers the toner image on the surface of the photosensitive drum 1 to the intermediate transfer belt 7.

A drive controller 504 which controls the drive of the photosensitive drum 1 is connected to the CPU 50. A drive motor 505 for the photosensitive drum 1 is connected to the drive controller 504. The display portion 506 which displays a message for a user or a menu screen is connected to the CPU 50.

(Process Cartridge Replacement Sequence)

Figure 7:
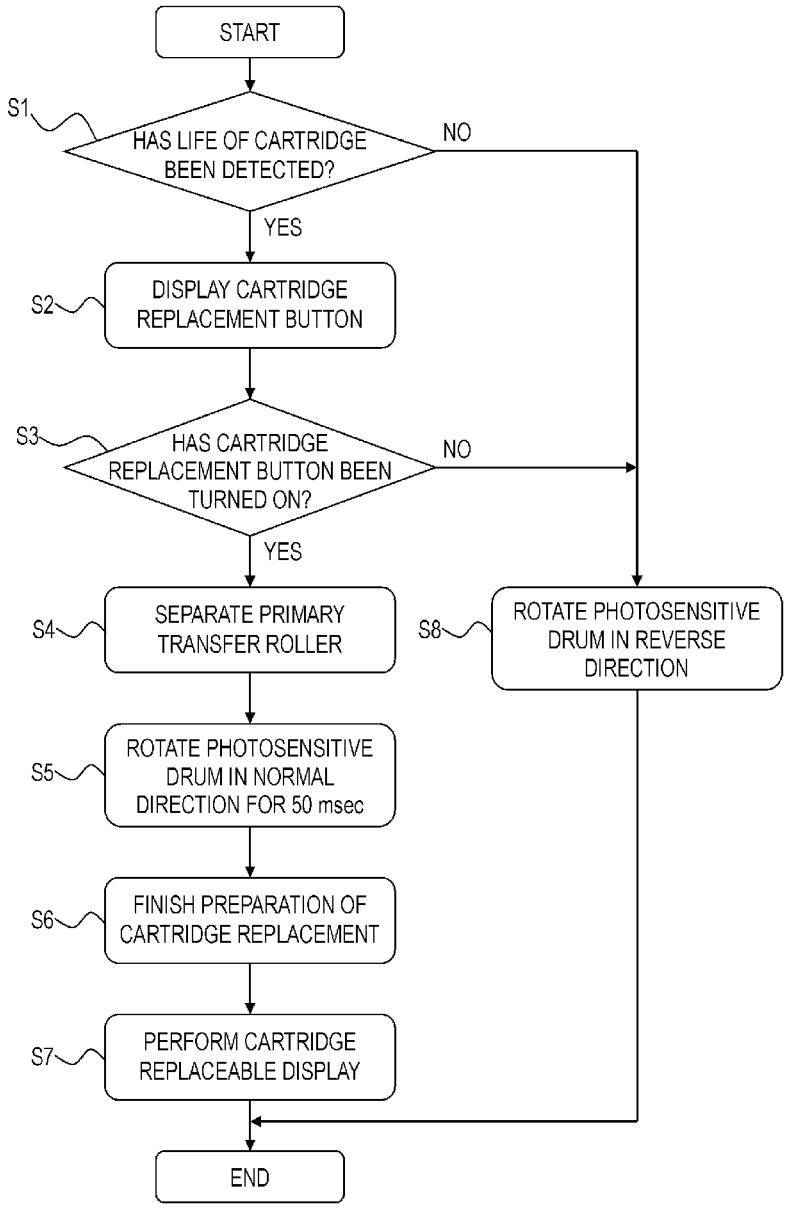
FIG. 7 is a flowchart illustrating a control process performed by the control system.

FIG. 7 is a flowchart illustrating a control process performed by the control system. The following contents are described with reference to FIG. 7. When a user replaces the cartridge 10, the CPU 50 rotates the photosensitive drum 1 in the normal rotation direction Z1 and performs display indicating that the cartridge 10 is replaceable, and the user replaces the cartridge 10. At this time, the CPU 50 rotates the photosensitive drum 1 in the reverse rotation direction to again collect the aggregated and stuck toner T into the cartridge 10. This prevents a user or an operator from making his/her hand dirty by touching the aggregated and stuck toner T.

The CPU 50 detects the life of the cartridge 10 (S1). The life of the cartridge 10 is determined by a cartridge traveling distance based on a total traveling distance when the photosensitive drum 1 in an uncharged state rotates and a total traveling distance when the photosensitive drum 1 rotates by the application of voltage by the charging roller 2J. In this case, the CPU 50 receives a drive signal and a charge application signal from the photosensitive drum 1 to calculate each total traveling distance. Alternatively, the life of the cartridge 10 may be determined by measuring the amount of AC current flowing through the photosensitive drum 1. The CPU 50 determines whether the cartridge traveling distance stored in the RAM 503 has reached a predetermined distance.

When a result is Yes in S1 (when detecting that the cartridge 10 has reached its life), the CPU 50 allows a replacement button for replacing the cartridge 10 to be displayed (S2). A switch which allows the display portion 506 of the apparatus body 100A to perform display for staring control of replacing the cartridge 10 is disposed inside the CPU 50.

The CPU 50 determines whether a signal (replacement signal) which indicates that a user has turned ON the cartridge replacement button on the display portion 506 has been received (S3). In the present embodiment, a detachably attachable mechanism between the primary transfer roller 5J and the photosensitive drum 1 is provided. When the operation is in a stopped state, the primary transfer roller 5J and the photosensitive drum 1 are in contact with each other only at a Bk station to standby.

When a result is YES in S3 (the replacement button has been turned ON), the CPU 50 separates the primary transfer roller 5J and the photosensitive drum 1 for color from each other (S4). The CPU 50 rotates the photosensitive drum 1 in the normal rotation direction for a normal rotation time (second predetermined time, 50 msec in the present embodiment) as a rotation time during which the photosensitive drum 1 is rotated in the same direction as the rotation direction during image formation (S5). A time which the CPU 50 rotates the photosensitive drum 1 with a normal direction rotation amount D in the normal rotation direction Z1 is desirably 75 ms or more.

In the present embodiment, even when the life has been detected, an image forming operation is not immediately inhibited. That is, when the life has been detected, but a user does not replace the cartridge, the next image formation is permitted. Thus, in the present embodiment, an operation of rotating the photosensitive drum in the reverse direction after the finish of image formation is performed regardless of whether the life has been detected. Further, the following configuration may be employed. When the life has been detected, the image forming operation may be inhibited. In this case, the cartridge is definitely replaced. Thus, when the life of the cartridge 10 has been detected, the CPU 50 may not perform control for rotating the photosensitive drum 1 in the reverse rotation direction.

The CPU 50 stops the rotation of the photosensitive drum 1 in the normal rotation direction Z1 to finish the operation (S6). The CPU 50 allows the display portion 506 to perform display indicating that the cartridge 10 is replaceable (S7).

When a result is NO in S1, the CPU 50 rotates the photosensitive drumlin the reverse rotation direction Z2 (S8). A reverse rotation time (first predetermined time) during which the CPU 50 rotates the photosensitive drum 1 in the reverse rotation direction Z2 is desirably set at 50 ms or more and less than 75 ms. A predetermined distance by which the photosensitive drum 1 rotates in the normal rotation direction Z1 is defined as the normal direction rotation amount D (refer to FIG. 8B). A predetermined distance by which the photosensitive drum 1 rotates in the reverse rotation direction Z2 is defined as the reverse direction rotation amount C (refer to FIG. 4). When the predetermined distances are defined in this manner, it is desired to satisfy the reverse direction rotation amount C< the normal direction rotation amount D and the reverse direction rotation amount C< (the first distance A or the second distance B)< the normal direction rotation amount D.

When a result is NO in S3, the CPU 50 makes a shift to step S8. When the replacement button of the cartridge 10 is not turned ON (for example, the replacement button is not turned ON within a predetermined time), a drum pitch streak of the photosensitive drum 1 is generated. Thus, the CPU 50 executes reverse rotation control upon the lapse of a predetermined time.

Figure 8A:
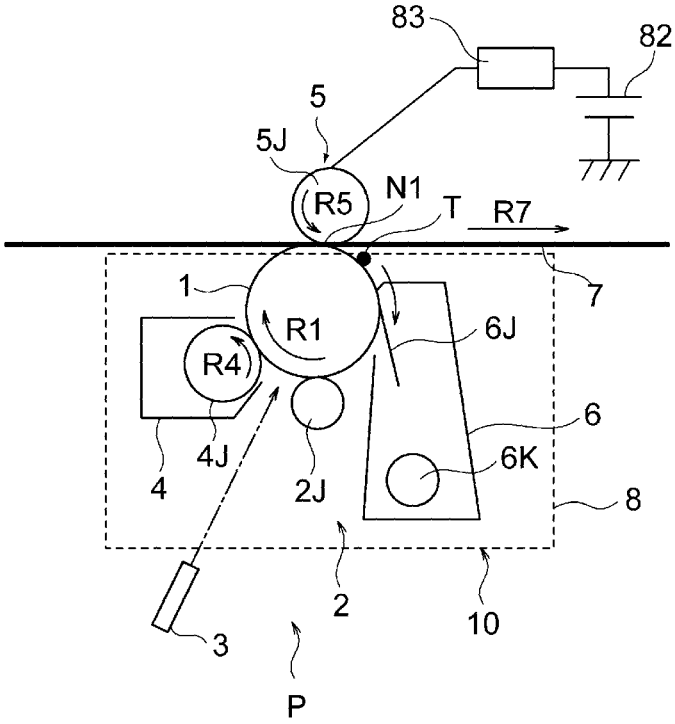
FIGS. 8A and 8B are sectional diagrams illustrating the position of aggregated and stuck toner when image formation is finished.

FIG. 8A is a sectional diagram illustrating the position of the aggregated and stuck toner T when image formation is finished. As illustrated in FIG. 8A, the photosensitive drum 1 is stopped to finish image formation.

Figure 8B:
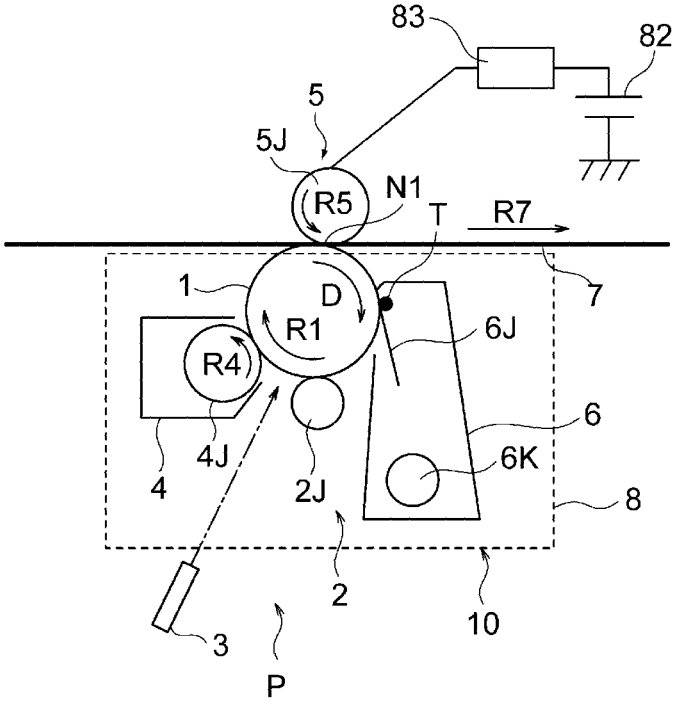

FIG. 8B is a sectional diagram illustrating the position of the aggregated and stuck toner T when the photosensitive drum 1 rotates in the normal rotation direction Z1. As illustrated in FIG. 8B, the CPU 50 rotates the photosensitive drum 1 in the normal rotation direction Z1 which is the same as the rotation direction of the photosensitive drum 1 during image formation by an amount larger than the reverse direction rotation amount C and the first distance A (refer to FIG. 4).

Accordingly, the aggregated and stuck toner T is collected into a position at which there is no possibility for a user to touch the aggregated and stuck toner T, that is, inside the cartridge 10 from a position at which a user may touch the aggregated and stuck toner T. In this manner, a user or an operator is prevented from making his/her hand dirty by touching the aggregated and stuck toner T on the surface of the photosensitive drum 1 when replacing the cartridge 10.

The configuration of the present embodiment prevents a user from making his/her hand dirty by touching the photosensitive drum 1 when the user takes out the cartridge 10 from the apparatus body 100A (when the user replaces the cartridge 10). In conventional image formation apparatuses, it is necessary to attach a cover which covers the surface of the photosensitive drum 1 to the cartridge 10 when the cartridge 10 is replaced. However, the cover is not required in the configuration of the present embodiment.

The present invention makes it possible to prevent a user from making his/her hand dirty by touching an image bearing member when the user takes out a cartridge from an apparatus body in a configuration that rotates the image bearing member in a reverse direction after the finish of job.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-246696, filed Dec. 5, 2014, which is hereby incorporated by reference herein in its entirety.

What is claimed is:

1. An image forming apparatus comprising:

a cartridge detachably attachable to the image forming apparatus, the cartridge including an image bearing member and a cleaning member which abuts against the image bearing member to remove remaining toner on the image bearing member after a toner image formed on the image bearing member is transferred to an intermediate transfer member or a recording material;

an inputting portion into which information for detaching the cartridge from the image forming apparatus is inputted; and an execution portion capable of executing a first operation of rotating the image bearing member in a direction reverse to a rotation direction of the image bearing member after an operation of forming an image is finished and a second operation of rotating the image bearing member in the rotation direction of the image bearing member when the information is inputted to the inputting portion.

2. The image forming apparatus according to claim 1, further comprising a transfer portion which transfers a toner image on a surface of the image bearing member to the intermediate transfer member or the recording material, wherein the execution portion executes the second operation such that a movement amount of the image bearing member in the second operation is greater than a distance on a peripheral face of the image bearing member between a transfer facing position which faces the transfer portion and a cleaning facing position which faces the cleaning portion.

3. The image forming apparatus according to claim 2, wherein the second operation is executed after the execution portion stops rotation of the image bearing member and separates the image bearing member from the transfer portion.

4. The image forming apparatus according to claim 1, further comprising a transfer portion which transfers a toner image on a surface of the image bearing member to the intermediate transfer member or the recording material, wherein the cartridge includes a charging portion which uniformly charges the surface of the image bearing member and a development portion which develops an electrostatic image on the surface of the image bearing member with a toner to form a toner image, and the execution portion executes the first operation such that a movement of the image bearing member in the first operation is less than at least one of a first distance on a peripheral face of the image bearing member between a transfer facing position which faces the transfer portion and a cleaning facing position which faces the cleaning portion or a second distance on the peripheral face of the image bearing member between a charging facing position which faces the charging portion and a development facing position which faces the development portion.

* * * * *